US006149020A

United States Patent [19]

Gumpel et al.

[11] Patent Number: 6,149,020

[45] Date of Patent: Nov. 21, 2000

[54] CEILING HUNG CLOTHESLINE SUPPORT

[76] Inventors: Tomas P. Gumpel; Maria S. Gumpel, both of 1216 Howard La., Bellaire, Tex. 77401

[21] Appl. No.: 09/390,287

[22] Filed: Sep. 3, 1999

Related U.S. Application Data

[60] Provisional application No. 60/099,760, Sep. 10, 1998.

[51] Int. Cl.[7] ..... D06F 53/00

[52] U.S. Cl. ..... 211/119.01

[58] Field of Search ..... 211/119.01, 119.03, 211/119.04, 117

[56] References Cited

U.S. PATENT DOCUMENTS

| | | | |
|---|---|---|---|
| 711,850 | 10/1902 | Hamilton . | |
| 806,401 | 12/1905 | Dawson | 211/119.01 |
| 1,030,493 | 6/1912 | Sorenson . | |
| 1,157,502 | 10/1915 | Budaji . | |
| 1,301,494 | 4/1919 | Orloff . | |
| 1,634,750 | 7/1927 | Jones | 211/117 |
| 1,663,297 | 3/1928 | Freuhauf | 211/117 |
| 2,479,137 | 8/1949 | Schudy . | |
| 2,736,438 | 2/1956 | Frey . | |
| 2,889,052 | 6/1959 | O'Neill . | |
| 2,950,822 | 8/1960 | Cope . | |
| 3,380,595 | 4/1968 | Klausen et al. . | |
| 5,240,128 | 8/1993 | Ohm . | |
| 5,375,727 | 12/1994 | Lavi . | |

FOREIGN PATENT DOCUMENTS

| | | |
|---|---|---|
| 167612 | 2/1955 | Australia . |
| 113788 | 7/1984 | European Pat. Off. . |
| 825601 | 12/1959 | United Kingdom . |
| 2290956 | 1/1996 | United Kingdom . |

*Primary Examiner*—Alvin Chin-Shue
*Assistant Examiner*—Sarah Purol
*Attorney, Agent, or Firm*—Richard C. Litman

[57] ABSTRACT

The ceiling hung clothesline support is an H-shaped aluminum frame having a plurality of substantially parallel clotheslines. The frame is suspended from a ceiling using a rope and pulley system, with one rope connected to each corner of the frame. The rope and pulley system is operated by a crank, which may be a self-locking hand crank or a motor driven crank. The clothesline is lowered for loading and unloading clothes, and then elevated while in use or for storage. The use of a single pulley system with a crank and with ropes attached to all four corners of the frame ensures that the clotheslines remain horizontal regardless of the distribution of clothes.

7 Claims, 2 Drawing Sheets

CEILING HUNG CLOTHESLINE SUPPORT

CROSS-REFERENCE TO RELATED APPLICATION

This application claims the benefit of U.S. Provisional Patent Application Ser. No. 60/099,760, filed Sep. 10, 1998.

BACKGROUND OF THE INVENTION

1. Field of the Invention

The present invention relates to clotheslines and laundry drying devices, and more particularly to a clothesline support which includes an aluminum frame suspended from the ceiling by a rope and pulley system operated by a crank.

2. DESCRIPTION OF RELATED ART

Despite the widespread availability of electric and gas powered clothes dryers, it is frequently advantageous to dry clothes by merely hanging them on a drying rack or clothesline and allowing moisture to evaporate. This drying method prevents damage to delicate clothes, reduces consumption of gas or electricity, prevents shrinkage, and prevents wrinkles. An indoor clothesline is also useful for apartment dwellers who have limited space or who have legal or zoning restrictions which prohibit extending a clothesline from a window to a nearby vertical post or support.

Several past inventors have devised various clothes drying line arrangements. However, no prior inventor known to the present inventor has developed a clothesline support which hangs from the ceiling, using a pulley system to lower the clothesline mounting frame for loading and unloading of clothes, and for raising the clothesline out of the way to dry the clothes. Additionally, the present inventor is unaware of any invention providing a means of raising and lowering such a clothesline support while keeping the frame level with unbalanced loads of clothing.

Many inventors have developed various pulley systems which either assist with loading and unloading the clothesline, or which raise or lower the frame out of the way when not in use. For example, U.S. Pat. No. 1,157,502, issued to Frank S. Budaji, describes a clothesline support wherein the clotheslines are stored indoors, and pulled outside through a window by a pulley system when needed. This patent fails to disclose an invention which is adaptable to overcome the noted problems when used indoors.

U.S. Pat. No. 1,301,494, issued to N. Orloff, describes a laundry hanger comprising a group of clotheslines in a pulley system, mounted outside a window. This patent fails to disclose an invention which is adaptable to overcome the noted problems when used indoors.

U.S. Pat. No. 5,240,128, issued to Heinz J. Ohm, describes a clothes drying frame having a central mast and a plurality of arms pivoting from a vertical collapsed position adjacent to the mast, and a horizontal extended position. A pulley system is used to move the arms from one position to the other. The arms are connected by a plurality of clotheslines. This patent fails to disclose an invention which can be elevated completely out of the way, regardless of whether it is in use.

U.S. Pat. No. 5,375,727, issued to Moshe Lavi, describes a clothes drying device having a plurality of clotheslines slidably mounted at each end on a rod. A pulley system is used to retract and extend the clotheslines. This patent does not disclose a vertically movable clothes drying rack or line.

Australian Pat. No. 167,612 describes a retractable clothes drying apparatus having a series of transverse drying wires mounted on longitudinal supporting wires. The drying wires are extended using a pulley system. The user places clothes on the first transverse wire, extends that wire away from him, and then repeats the process with each successive transverse wire.

At least three inventors have proposed clothes drying racks which pivot out of the way when not in use. The first, U.S. Pat. No. 2,736,438, issued to Norman E. Frey, describes a clothes drying rack having a plurality of clotheslines attached to a wall-mounted frame. The frame pivots from a vertical storage position adjacent to the wall to a horizontal drying position. The second, U.S. Pat. No. 2,950,822, issued to A. C. Francis Cope, describes a collapsible clothes rack having a plurality of clotheslines between a pair of hinged end members. To collapse the rack, the end members are pivoted horizontally in the same direction towards the wall. Lastly, European Pat. App. No. 0,113,788 appears to show a clothes drying rack attached to a wall, which can be pivoted out of the way using a pulley system. Although these drying racks may be pivoted out of the way during storage, they can not be elevated out of the way by a pulley system during use.

At least two inventors have proposed telescoping clothes drying racks. The first, U.S. Pat. No. 2,889,052, issued to James C. O'Neill, describes a clothes drying rack having multiple clotheslines extending between telescoping frame members. The second, U.S. Pat. No. 3,380,595, issued to Svend E. Klausen and Carl A. Jacobsen, describes a clothes drying rack comprising a telescoping central tube having a U-shaped bracket on either end, and a plurality of adjustable-length clotheslines connected at either end to the U-shaped brackets. Before use, the clothes rack is extended so that it is supported by friction between two parallel vertically oriented surfaces. None of these inventions allow loading in a lowered position, and then elevating the drying rack to an elevated position during use.

At least one inventor has proposed a clothes drying device having both pivoting and telescoping members. Great Britain Pat. App. No. 2,290,956, describes a vertically telescoping clothes drying device having horizontal clothes support rods. The clothes support rods pivot into a vertical position when not in use. This patent does not disclose a drying device which can be elevated out of the way during use.

Great Britain Pat. No. 825,601 describes a clothesline having one end which can be raised and lowered. This invention does not have a compact drying frame, but relies on a single clothesline.

Montgomery Ward Fall & Winter Catalog (Baltimore, Md.: 1964), p. 1081, shows several different products for hanging clothes during drying. Two wall-mounted, retractable clotheslines having multiple lines for hanging clothes, and rollers to store the lines when not in use, are shown. Two folding drying racks having rigid bars for supporting the drying clothes are shown. Lastly, two free-standing drying racks having multiple clotheslines are shown.

U.S. Pat. No. 2,479,137, issued to Frank Schudy, describes a line tightening clothesline bracket using a hand crank attached to a threaded shaft to vary the tension in the clothesline.

At least two inventors developed awnings which extend and collapse using a pulley system operated by a hand crank: U.S. Pat. No. 711,850, issued to Clarence S. Hamilton and U.S. Pat. No. 1,030,493, issued to Edwin Sorenson.

None of the above inventions and patents, taken either singly or in combination, is seen to describe the instant invention as claimed.

SUMMARY OF THE INVENTION

The invention is a ceiling hung clothesline support. The clothesline support comprises an H-frame, preferably made of one inch diameter aluminum tubing, although use of this material is not mandatory but preferred for weight and strength considerations. A preferred embodiment includes two parallel aluminum tubes, with a third aluminum tube connecting the center of one parallel tube to the center of the other. A preferred and suggested means of connecting the aluminum tubes is plastic T-connectors. Suggested dimensions are approximately fifty inches long and twenty-seven inches wide, but the size of the frame may be varied to suit the needs of the user.

A plurality of substantially parallel clotheslines extend from one of the parallel aluminum rods to the other. Although different numbers of clotheslines may be used, six is a suggested number.

The aluminum frame is suspended from a ceiling using a rope and pulley system. One rope attaches to each corner of the frame, and then passes around a pulley attached to the ceiling directly above that corner. All four ropes then run horizontally across the ceiling to a second set of four pulleys, mounted adjacent to each other at a wall. The ropes go around these second pulleys, and downward along the wall, until they attach to a self-locking hand crank mounted at the wall. A motor-driven crank may be used as an alternative to a hand crank.

The invention is stored in its elevated position, where it will not interfere with other uses of the room. To use the invention, it is lowered using the self-locking hand crank until it is at a comfortable height for putting clothes over the clotheslines. Once the clothing is put on the lines and on the connecting aluminum tube, the invention is elevated using the hand crank so that it does not interfere with other activity. When the clothes are dry, the invention is lowered, the clothing is removed, and the invention is elevated for storage.

The use of a single pulley system operated by a single hand crank, having ropes attached to all four corners of the drying rack keeps the frame horizontal regardless of the distribution of clothing across the rack.

Accordingly, it is a principal object of the invention to provide a clothesline support which hangs from the ceiling to avoid interfering with furniture or people.

It is another object of the invention to provide a clothesline for indoor use, avoiding the inconvenience and weather conditions which may preclude the use of a clothesline outside the home.

It is a further object of the invention to provide a large amount of hanging space inside a laundry room. For example, if the preferred dimensions are used, clothes may be hung from any of six lines or one connecting tube, all approximately 4 feet long, providing a total of 28 feet of hanging space.

Still another object of the invention is to provide a clothesline support which can be lowered to a convenient height for loading and unloading clothes.

An additional object of the invention is to provide a clothesline having a frame which remains horizontal regardless of the distribution of clothing across the frame.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a ceiling hung clothesline support. The invention comprises an H-frame supporting a plurality of clotheslines, the frame being suspended by a pulley system. The frame is elevated and lowered using either a hand crank or motor-driven crank.

Figure 1:
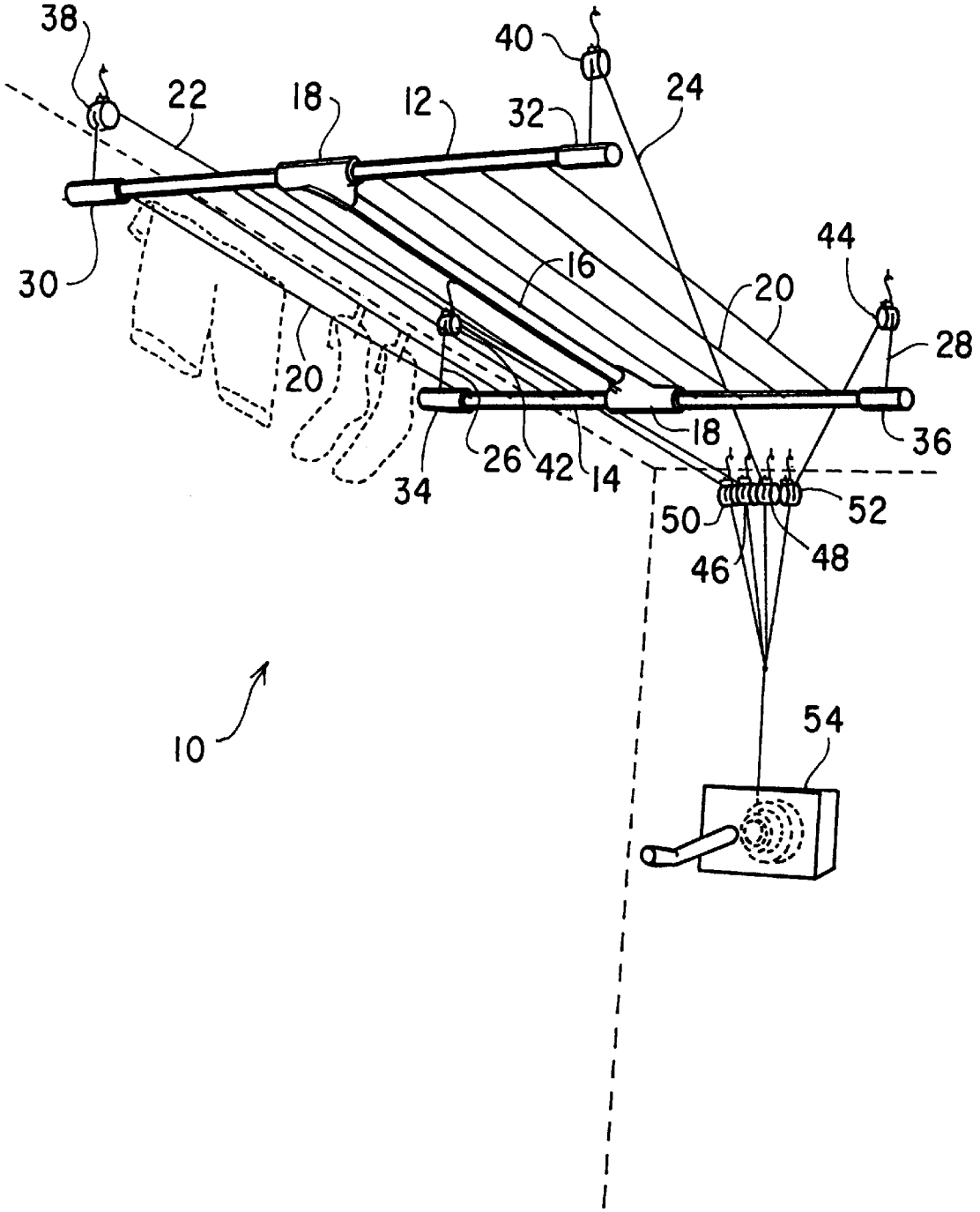
FIG. 1 is an environmental, perspective view of a ceiling hung clothesline support according to the present invention in its elevated position, showing the clothesline having a self-locking hand crank.
Figure 2:
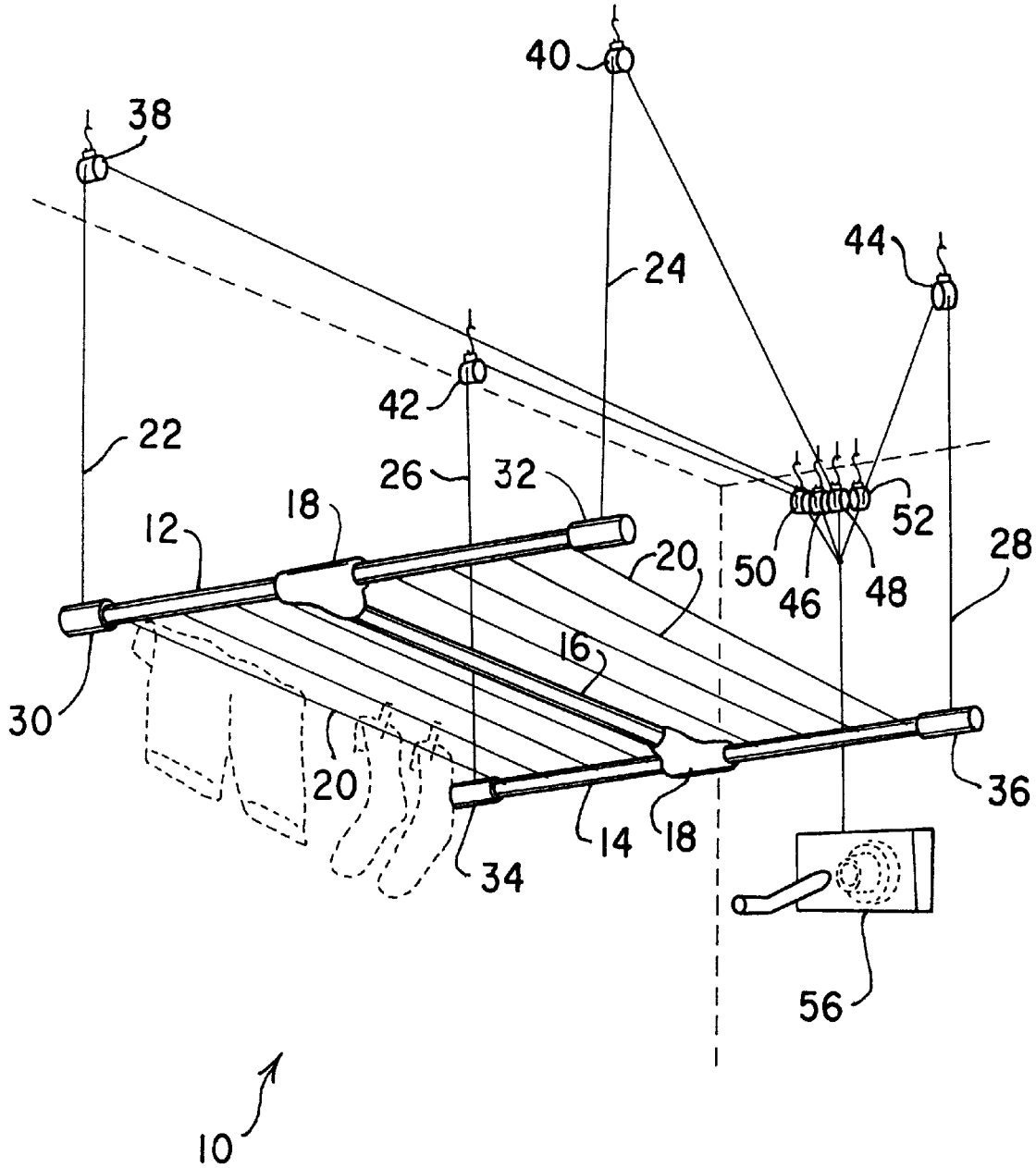
FIG. 2 is an environmental, perspective view of a ceiling hung clothesline support according to the present invention in its lowered position, showing the clothesline having a motor-driven crank.

Referring to FIGS. 1 and 2, the clothesline support 10 comprises a pair of parallel, one inch diameter, linear aluminum tubes 12,14, of substantially equal length and linear connecting aluminum tube 16. Connecting tube 16 connects to the center of parallel tubes 12,14 using plastic T-connectors 18 and is substantially perpendicular to tubes 12,14. The resulting frame is H-shaped, with parallel tubes 12,14 defining the legs of the H and the connecting tube 16 defining the crossbar of the H. The ends 30,32,34,36 of the legs 12,14 define the four corners of the frame.

A plurality of flexible clotheslines 20 extend from tube 12 to tube 14, generally parallel both to each other and to connecting tube 16. The clotheslines 20 may be strings, ropes, thin wire encased in a plastic sheath, or other flexible cord, as is well known in the art. As shown in the drawings, preferably an equal number of clotheslines 20 are disposed on either side of connecting tube 16 in order to provide for a symmetrical, even distribution of weight.

Attached to tubes 12,14 are ropes 22,24,26,28 which suspend the frame from the ceiling by each passing through a different one of a set of pulleys 38,40,42,44 fixedly hung from a ceiling or other planar, horizontally disposed, elevated partition of a building or structure. Conventional attachment means for joining each pulley to the ceiling may be used, such as toggle bolts and swivels, or the like. Each rope 22,24,26,28 attaches to a different end 30,32,34,36 of parallel tubes 12,14. Ropes 22,24,26,28 each pass through a different suspension pulley 38,40,42,44, each of which is suspended from the ceiling directly above one end 30,32, 34,36 of parallel tubes 12,14. Ropes 22,24,26,28 then each extend towards and around a different guide pulley 46,48, 50,52, located adjacent to a wall. Each of ropes 22,24,26,28 extend downward from its associated guide pulley 46,48, 50,52 to a self-locking hand crank 54, shown in FIG. 1, or a motor-driven crank 56, shown in FIG. 2. (Such cranks 54 and 56 are well known in the mechanical arts, and will not be described further). The ropes 22,24,26,28 are yoked by a ring, S-hook, clamp or other means, to form a junction 55 at a predetermined point between the pulleys 46,48,50,52 and the crank 54 or 56, from which a single line 57 continues onto an uptake reel of the crank 54 or 56. The length of the ropes 22,24,26,28 and the length of the single line 57 generally determine the distance that the frame can be lowered. One consequence of this construction is that the clothesline support 10 is raised evenly, the ropes 22,24,26,28 raising the four corners 30,32,34,36 of the frame simultaneously through the same distance.

To use the clothesline support 10, the frame begins in the elevated position shown in FIG. 1. In this position when installed in a typical basement with an eight foot ceiling, it will not interfere with people or furniture. Using hand crank 54 or motor-driven crank 56, ropes 22,24,26,28 are unwound, the frame being lowered to a comfortable height for placing clothes on clotheslines 20, as shown in FIG. 2. As noted above, the length of the ropes 22,24,26,28 and the length of single line 57 generally determine the distance that the frame can be lowered. Once the clothing is placed on clotheslines 20, hand crank 54 or motor driven crank 56 can be used to wind ropes 22,24,26,28, thereby lifting the frame to its elevated position.

When the clothes are dry, hand crank 54 or motor-driven crank 56 is used to unwind ropes 22,24,26,28, lowering clothesline support 10. The clothing is removed. Hand crank 54 or motor-driven crank 56 is used to wind ropes 22,24, 26,28, raising clothesline support 10 to its elevated position for storage.

The use of one rope attached to each corner of the rack, all operated simultaneously by the same crank, ensures that the frame remains horizontal, regardless of the distribution of clothes across the rack.

It is to be understood that the present invention is not limited to the sole embodiment described above, but encompasses any and all embodiments within the scope of the following claims.

We claim:

1. A ceiling hung clothesline support adapted for attachment to a ceiling of a structure, the ceiling having an adjacent wall, the clothesline support comprising:

a) a frame, having:

i) a first leg having a first end and a second end;

ii) a second leg having a third end and a fourth end, the second leg being substantially equal in length to the first leg and being disposed parallel to the first leg; and iii) at least one crossbar joining the first leg to the second leg; and b) a rope and pulley system adapted for suspending said frame from a ceiling, wherein said a rope and pulley system comprises:

i) four ropes, including a first rope attached to the first end of said first leg, a second rope attached to the second end of said first leg, a third rope attached to the third end of said second leg, and a fourth rope attached to the fourth end of said second leg, respectively, said first, second, third and fourth ropes having a free end;

ii) a first set of four suspension pulleys adapted for attachment to the ceiling, each pulley being directly above one of the first, second, third and fourth ends, respectively;

iii) a second set of four guide pulleys adapted for attachment to a wall adjacent the ceiling;

iv) a single line, said first, second, third, and fourth ropes extending over said suspension pulleys, thence over said guide pulleys and being yoked together and joined to said single line; and v) a crank, said single line being attached to said crank, whereby the four ends of said frame are raised and lowered by an equal distance simultaneously.

2. The ceiling hung clothesline support according to claim 1, wherein said frame is made from aluminum tubing.

3. The ceiling hung clothesline support according to claim 1, wherein said at least one crossbar consists of one crossbar, said one crossbar being perpendicular to and bisecting said first leg, and being perpendicular to and bisecting said second leg in order to define an H-shaped frame.

4. The ceiling hung clothesline support according to claim 1, wherein said crank is a self-locking hand crank.

5. The ceiling hung clothesline support according to claim 1, wherein said crank is motor-driven.

6. The ceiling hung clothesline support according to claim 1, further comprising at least one clothesline extending between said first leg and said second leg.

7. The ceiling hung clothesline support according to claim 1, further comprising a plurality of clotheslines extending between said first leg and said second leg, said plurality of clotheslines being symmetrically distributed on opposite sides of said at least one crossbar.

* * * * *